US012497699B2

(12) United States Patent
Yoshiba et al.

(10) Patent No.: US 12,497,699 B2
(45) Date of Patent: Dec. 16, 2025

(54) PLATING STACK

(71) Applicant: JAPAN PURE CHEMICAL CO., LTD., Tokyo (JP)

(72) Inventors: Kenji Yoshiba, Tokyo (JP); Yusuke Yaguchi, Tokyo (JP); Hiroshi Minowa, Tokyo (JP)

(73) Assignee: JAPAN PURE CHEMICAL CO., LTD., Tokyo (JP)

( * ) Notice: Subject to any disclaimer, the term of this patent is extended or adjusted under 35 U.S.C. 154(b) by 605 days.

(21) Appl. No.: 17/799,957

(22) PCT Filed: Feb. 3, 2021

(86) PCT No.: PCT/JP2021/003847
§ 371 (c)(1),
(2) Date: Aug. 16, 2022

(87) PCT Pub. No.: WO2021/166640
PCT Pub. Date: Aug. 26, 2021

(65) Prior Publication Data

US 2023/0069914 A1 Mar. 9, 2023

(30) Foreign Application Priority Data

Feb. 18, 2020 (JP) ..... 2020-025108

(51) Int. Cl.
*C23C 18/16* (2006.01)
*C23C 18/38* (2006.01)
*C23C 18/42* (2006.01)

(52) U.S. Cl.
CPC ..... *C23C 18/165* (2013.01); *C23C 18/38* (2013.01); *C23C 18/42* (2013.01)

(58) Field of Classification Search
CPC ..... C23C 18/1651; C23C 18/38; C23C 18/42
See application file for complete search history.

(56) References Cited

U.S. PATENT DOCUMENTS 12,221,699 B2 * 2/2025 Yoshiba ..... C23C 18/1651
2012/0024713 A1 2/2012 Preisser
(Continued)

FOREIGN PATENT DOCUMENTS

CN 102112660 A 6/2011
CN 109312463 A 2/2019
(Continued)

OTHER PUBLICATIONS

Human assisted Machine translation Qiu et al. (TW2016/36454) , publication date Oct. 16, 2016.*
(Continued)

*Primary Examiner* — Jun Li
(74) *Attorney, Agent, or Firm* — WHDA, LLP

(57) ABSTRACT

In the method for producing a plating stack, a plating layer A mainly composed of a second metal is deposited on an object to be plated S mainly composed of a first metal by a substitution reaction, then a plating layer B mainly composed of a third metal is deposited on the plating layer A, and then a plating layer C mainly composed of the second metal, the third metal, or a fourth metal is deposited on the plating layer B by a redox reaction. A concrete configuration of plating layers includes, for example, the plating layer A is gold, platinum or silver, the plating layer B is palladium, and the plating layer C is palladium.

4 Claims, 1 Drawing Sheet

(56) References Cited

U.S. PATENT DOCUMENTS

| | | | | |
|---|---|---|---|---|
| 2014/0290857 | A1 | 10/2014 | Miyoshi et al. | |
| 2015/0357277 | A1* | 12/2015 | Nagai | H05K 3/4007 174/255 |
| 2016/0254608 | A1* | 9/2016 | Takahashi | C25D 3/38 439/886 |
| 2019/0070631 | A1* | 3/2019 | Fujikawa | B05D 7/24 |
| 2019/0345612 | A1 | 11/2019 | Tanabe et al. | |
| 2021/0348276 | A1* | 11/2021 | Nakamura | C23C 18/2086 |
| 2022/0025530 | A1* | 1/2022 | Funakawa | C25B 1/46 |
| 2023/0065609 | A1* | 3/2023 | Yoshiba | B32B 15/01 |

FOREIGN PATENT DOCUMENTS

| | | | |
|---|---|---|---|
| CN | 111183245 | A | 5/2020 |
| JP | 2005-317729 | A | 11/2005 |
| JP | 2013-093359 | A | 5/2013 |
| JP | 2013-108180 | A | 6/2013 |
| JP | 2014-129612 | A | 7/2014 |
| JP | 2017-222891 | A | 12/2017 |
| TW | 201216408 | A | 4/2012 |
| TW | 201636454 | A * | 10/2016 |

OTHER PUBLICATIONS

International Search Report dated Mar. 16, 2021, issued in counterpart International Application No. PCT/JP2021/003847. (2 pages).

Notice of Reasons for Refusal dated May 19, 2020, issued in counterpart of Japanese Patent Application No. 2020-025108, with English Translation. (5 pages).

Office Action dated Jun. 27, 2023, issued in counterpart CN application No. 202180012983.9 with English machine translation. (14 pages).

Office Action dated Dec. 5, 2023, issued in counterpart CN Application No. 202180012983.9, with English machine translation. (14 pages).

Office Action dated Sep. 29, 2025, issued in counterpart KR application No. 10-2022-7030863, with English translation. (8 pages).

* cited by examiner

[Figure 1]
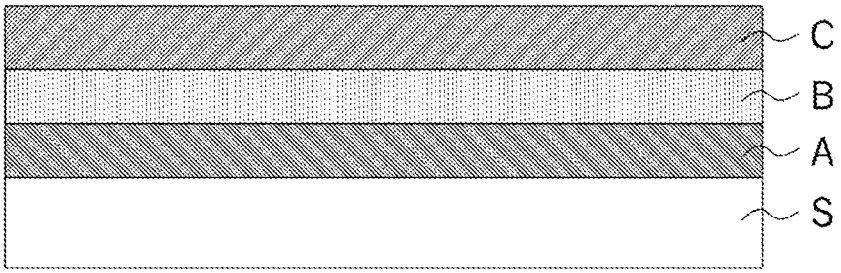
[Figure 2]
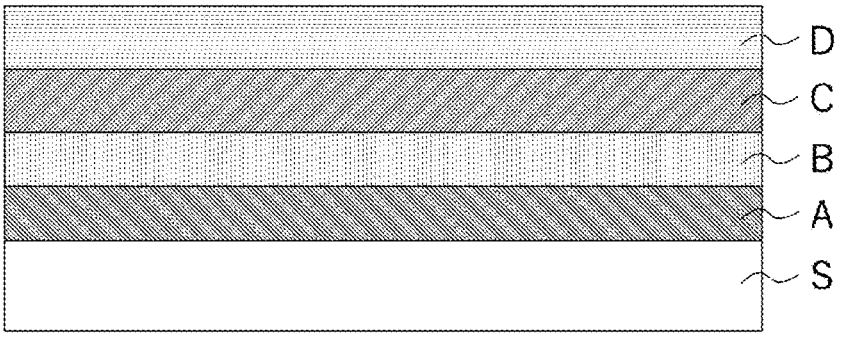

PLATING STACK

TECHNICAL FIELD

The present invention relates to a method for producing a plating stack, and more specifically to a method for producing a plating stack which is formed on a conductor circuit or the like.

BACKGROUND ART

Generally, a semiconductor device has a conductor circuit made of a metal having a low electrical resistance such as copper or silver. Further, for almost all conductor circuits, solder bonding or wire bonding is performed.

However, when surfaces of these conductor circuits are oxidized, solder bonding and wire bonding becomes difficult.

Therefore, a plating film is formed on a surface of an object to be plated that forms conductor circuits, and then solder bonding or wire bonding is performed on the plating film.

In particular, with the recent miniaturization and densification of wiring, the application of the electroless plating technique that does not require the wiring for electrolytic plating, is generally performed.

Among them, three-layer film composed of electroless nickel, palladium and gold (ENEPIG film), and two-layer film composed of electroless palladium and gold (EPIG film), are known as film formed on surface of conductor circuits, which are suitable for solder bonding and wire bonding.

There are two kinds of methods for formation of film by electroless plating: plating mainly by substitution reactions (hereinafter sometimes referred to as "substitution plating"), and plating mainly by reduction reactions (hereafter, sometimes referred to as "reduction plating").

Substitution plating is mainly the following reaction. That is, when an object to be plated is immersed in a solution (hereinafter sometimes referred to as "plating solution") containing ions of "metal for forming a plating film", component metal of the object to be plated becomes metal ions and elutes into the plating solution. At the same time, released electrons are given to the ions of "metal for forming a plating film", and the ions given electrons the are deposited as metal on the surface of the object to be plated.

Reduction plating is mainly the following reaction. That is, when an object to be plated is immersed in a plating solution containing a reducing agent, oxidation reaction of a reducing agent proceeds. At the same time, released electrons are given to the ions of "metal for forming a plating film", and the ions given electrons the are deposited as metal on the surface of the object to be plated.

Substitution plating involves several problems. For example, there is a constraint based on the ionization tendency in the combination of component metal of an object to be plated and "metal for forming a plating film". Also, film thickness of a plating film to be deposited hardly to be thick. Further, an object to be plated may locally corrode.

Therefore, reduction plating tends to be used when these problems need to be avoided.

However, attempting the reduction plating for the purpose of the plating film formation, the oxidation reaction of the reducing agent does not always proceed on the surface of an object to be plated. Then, the reduction plating does not proceed if the oxidation reaction of the reducing agent does not proceed.

Therefore, performing reduction plating on an object to be plated on which reduction plating does not proceed or hardly to proceed, the reduction plating is performed after adding palladium or its alloys, etc. on the object to be plated as catalysts (for example, see Patent Document 1). On the surface of palladium or its alloys, etc. oxidation reaction of a reducing agent easily proceeds.

However, when a film is formed by these known surface treatment methods, a phenomenon as exemplified below may occur. That is, an object to be plated is locally corroded during the addition of catalysts. Further, an oxidation layer is formed on the surface of the object to be plated. As a result, in case film thickness of a reduction plating film formed is thin, there is a problem that voids are likely to generate inside solder in vicinity of bonding part during solder bonding. If voids are present in the solder bonding part, there is a case where sufficient solder bonding strength cannot be obtained.

It has also been investigated to perform plating in which voids are not generated at the time of solder bonding stably, by adding a catalyst while preventing local corrosion of an object to be plated and formation of an oxidized layer on the surface of an object to be plated (e.g., Patent Document 2 and 3).

However, the types of catalyst metals that can be added by these methods are limited to a portion of metals, such as gold. Reduction plating is more difficult to progress in these methods than that in conventional methods using palladium or its alloys, etc. as catalysts.

For this reason, in these methods, when the reduction plating solution is contaminated with pollutants, etc. and the plating solution deteriorates, skipping of reduction plating (phenomenon in which deposition of plating film does not occur when the predetermined plating treatment is performed) may occur.

Recently, since miniaturization and densification of wiring of conductor circuit is progressing more and more, development of a technology capable of performing solder bonding and wire bonding of such conductor circuit reliably, is desired.

PRIOR ART DOCUMENTS

Patent Documents

Patent Document 1: JP 2005-317729 A
Patent Document 2: JP 2013-108180 A
Patent Document 3: JP 2017-222891 A

SUMMARY OF THE INVENTION

Problems to be Solved by the Invention

The present invention has been accomplished in view of the above-mentioned background art, and a problem to be solved is to provide a plating stack (a stack of plating films) for applying on surface of conductor circuits or the like. The plating stack can maintain high bond strength when solder is bonded on that and can be produced stably.

Means for Solving the Problems

As a result of extensive studies to solve the above problems, the present inventor has found the following and has completed the present invention. That is, instead of arranging a plating layer B directly on an object to be plated, arranging a plating layer A between the object to be plated and the plating layer B, solder bondability of a plating stack becomes good. Here, the plating layer B is a layer of palladium or its alloys, etc. On the surface of the plating layer B, oxidation reaction of a reducing agent (i.e., stacking of a new layer (a plating layer C) by a reduction plating solution) easily proceeds. The plating layer A is a layer for preventing local corrosion of the object to be plated and formation of an oxidized layer on the surface of the object to be plated during formation of the plating layer B. To sum it up, solder bondability of a plating stack which is stacked in the order of the plating layer A, the plating layer B, and the plating layer C is good. Further, in the case of such a layer configuration, skipping of the plating layer C by reduction plating is also less likely to occur.

That is, the present invention is directed to a method for producing a plating stack in which a plating layer A mainly composed of a second metal is deposited on an object to be plated mainly composed of a first metal, then a plating layer B mainly composed of a third metal is deposited on the plating layer A, and then a plating layer C mainly composed of the second metal, the third metal, or a fourth metal is deposited on the plating layer B, wherein the plating layer B is a substitution plating layer formed by a substitution reaction between an ion of the third metal contained in a substitution plating solution, and the first metal contained in the object to be plated or the second metal contained in the plating layer A, wherein the plating layer C is a reduction plating layer not mainly composed of gold and/or nickel, formed by a redox reaction between a reducing agent and a metal ion contained in a reduction plating solution.

Effects of the Invention

According to the present invention, a plating stack (a stack of plating films) for applying on surface of conductor circuits or the like, can be provided. The plating stack can maintain high bond strength when solder is bonded on that and can be produced stably.

BRIEF DESCRIPTION OF DRAWINGS

FIG. 1 is a schematic diagram showing the structure of the plating stack produced by the present invention.

FIG. 2 is a schematic diagram showing the structure of the plating stack produced by the present invention (where the plating stack has a plating layer D).

EMBODIMENTS TO CARRY OUT THE INVENTION

In the following, the present invention is explained, but the present invention is not limited by the following specific embodiments, and can be optionally changed.

The present invention relates to a method for producing a plating stack in which a plating layer A mainly composed of a second metal is deposited on an object to be plated S mainly composed of a first metal, then a plating layer B mainly composed of a third metal is deposited on the plating layer A, and then a plating layer C mainly composed of the second metal, the third metal, or a fourth metal is deposited on the plating layer B. FIG. 1 shows the structure of the plating stack produced by the present invention.

In the present specification, "plating layer" means a layer of metal formed by plating. The "plating layer" is not limited to a film-like layer without pores. A film-like layer with pores and nucleus-like layer is also included in the "plating layer".

"First metal", "second metal", "third metal" and "fourth metal", which constitute the plating layer in the present invention are all metals which differ from each other.

Metals which constitute the plating layer in the present invention are not limited to pure metals, and may be alloys. In addition, elements other than metals (e.g., phosphorus (P), sulfur (S), boron (B), carbon (C), and the like) may be contained in the plating layer in the present invention.

"A plating layer is mainly composed of metal X" means that, metal X is the most abundant metal on a molar basis in the plating layer.

Examples of the plating layer in the present invention include a substitution plating layer formed by a substitution reaction, a reduction plating layer formed by a redox reaction, and the like.

"Formed by a substitution reaction" includes not only a case where a plating layer is formed only by a substitution reaction but also a case where a substitution reaction and a redox reaction occur simultaneously to form a plating layer. When a substitution reaction and a reduction reaction occur simultaneously, among the metals in the plating layer, preferably 60% or more is formed by the substitution reaction, more preferably 80% or more is formed by the substitution reaction, and particularly preferably 90% or more is formed by the substitution reaction.

"Formed by a redox reaction" includes not only a case where a plating layer is formed only by a redox reaction but also a case where a redox reaction and a substitution reaction occur simultaneously to form a plating layer. When a redox reaction and a substitution reaction occur simultaneously, among the metals in the plating layer, preferably 60% or more is formed by the redox reaction, more preferably 80% or more is formed by the redox reaction, and particularly preferably 90% or more is formed by the redox reaction.

<Object to be Plated S>

An object to be plated S is a substrate for the formation of a plating layer on it. The object to be plated S is mainly composed of a first metal. The first metal is a metal that forms conductor circuits. Examples of the first metal are copper (Cu) and silver (Ag).

<Plating Layer A>

A plating layer A is a plating layer to be deposited on an object to be plated S. The plating layer A is mainly composed of a second metal.

The second metal is a metal that can be deposited from a plating solution to the object to be plated S without local corrosion of the object to be plated S or formation of an oxidation layer on the surface of the object to be plated S. The second metal is not particularly limited as long as it can be stably present in an aqueous solution.

Examples of the second metal are gold (Au), silver (Ag), platinum (Pt), rhodium (Rh), iridium (Ir), indium (In), tin (Sn), ruthenium (Ru), iron (Fe), zinc (Zn), nickel (Ni) and cobalt (Co).

Gold, silver or platinum is particularly preferable to be used as the second metal, because they can easily form on the surface of the object to be plated as a plating layer A and they have great preventive effects of local corrosion of the object to be plated S and formation of the oxidation layer on the surface of the plating body S.

Plating solution for forming the plating layer A is not particularly limited, as long as the solution does not locally corrode the object to be plated, and does not form an oxidation layer on the surface of the object to be plated at the time of formation of the plating layer A. The plating solution for forming the plating layer A may be a substitution plating solution or reduction plating solution.

A substitution plating solution for forming a plating layer A contains a water-soluble metal salt (a salt of a second metal). The second metal has an ionization tendency capable of substitution with a first metal. In other words, when the plating layer A is formed by the substitution plating solution, the second metal has lower ionization tendency than that of the first metal.

A reduction plating solution for forming the plating layer A contains a water-soluble metal salt (a salt of a second metal) and a reducing agent.

Examples of the reducing agent are hydrazine, sodium borohydride and formaldehyde. One type of the reducing agents may be used alone, or two or more type thereof may be used.

A water-soluble metal salt (a salt of a second metal) contained in a plating solution for forming a plating layer A is not particularly limited.

When the second metal is gold, examples of the salt of a second metal are gold cyanide salt, gold chloride salt, gold sulfite salt and gold thiosulfate salt.

When the second metal is silver, examples of the salt of a second metal are silver cyanide salt, silver nitrate salt, and silver methanesulfonate salt.

When the second metal is platinum, examples of the salt of a second metal are chloroplatinic acid salt, dinitrodiammine platinum, and hexahydroxoplatinate salt.

Concentration of a water-soluble metal salt (a salt of a second metal) in a plating solution for forming a plating layer A is not particularly limited. The concentration is preferably 5 ppm or more, more preferably 10 ppm or more, and particularly preferably 20 ppm or more. Besides, the concentration is preferably 5000 ppm or less, more preferably 2000 ppm or less, and particularly preferably 1000 ppm or less.

When the concentration is more than or equal to the above lower limit, formation rate of the plating layer A becomes sufficiently large. Further, when the concentration is equal to or lower than the above upper limit, it is advantageous in terms of cost.

PH of the plating solution for forming a plating layer A is preferably 2.5 or more, more preferably 3 or more, and particularly preferably 4 or more. Besides, the pH is preferably 9.5 or less, more preferably 9 or less, and particularly preferably 8 or less.

When the pH is within the above range, local corrosion of the object to be plated and formation of an oxidation layer on the surface of the plating body are unlikely to occur, thus it is easy to keep a plating stack at high quality.

Film thickness of a plating layer A is not particularly limited. The film thickness is preferably 0.0003 μm or more, more preferably 0.0005 μm or more, and particularly preferably 0.001 μm or more. Besides, the film thickness is preferably 0.05 μm or less, more preferably 0.04 μm or less, and particularly preferably 0.02 μm or less.

When the film thickness is more than or equal to the above lower limit, in the next step, that is, formation of a plating layer B, local corrosion of the object to be plated and formation of an oxidation layer on the surface of the plating body are unlikely to occur, thus it is easy to keep a plating stack at high quality. Further, when the film thickness is equal to or lower than the above upper limit, it is advantageous in terms of cost.

Since the plating layer A is not the outermost layer, the plating layer A is not necessary to be flat film. The plating layer A may be porous film or nucleus-like layer.

The "film thickness" means the average film thickness (the same applies below in the present specification).

Temperature of a plating solution at the time of forming a plating layer A is preferably 10° C. or higher, more preferably 15° C. or higher, and particularly preferably 20° C. or higher. Besides, the temperature is preferably 100° C. or lower, more preferably 95° C. or lower, and particularly preferably 90° C. or lower.

Further, time for forming the plating layer A (plating time) is preferably 0.5 minutes or more, more preferably 1 minute or more, and particularly preferably 2 minutes or more. Besides, the plating time is preferably 30 minutes or less, more preferably 20 minutes or less, and particularly preferably 10 minutes or less.

When the temperature and the plating time are within the above range, the film thickness tends to be within the above range.

As mentioned above, the plating layer A is not required for thickness. Therefore, it is preferable to form the plating layer A with a substitution plating solution in terms of cost and avoidance of effect caused by the reducing agent. That is, it is preferable that the plating layer A is a substitution plating layer formed by a substitution reaction between an ion of the second metal contained in a substitution plating solution and the first metal contained in the object to be plated.

<Plating Layer B>

A plating layer B is a plating layer to be deposited on a plating layer A. The plating layer B is mainly composed of a third metal.

The plating layer B is a substitution plating layer formed by a substitution reaction between an ion of the third metal contained in a substitution plating solution, and the first metal contained in the object to be plated or the second metal contained in the plating layer A.

As described above, a plating layer A may be porous film or nucleus-like layer. Therefore, the substitution reaction for forming the plating layer B may occur between an ion of the third metal and the first metal contained in the object to be plated S.

The third metal is not particularly limited as long as it can be deposited from the plating solution, can proceed reduction plating for forming a plating layer C on its surface stably, and can be stably present in an aqueous solution.

Examples of the third metal are palladium (Pd) and rhenium (Re). Palladium is particularly preferable as the third metal contained in the plating layer B, because reduction reaction proceeds easily on its surface and the plating layer C can be suitably formed by reducing plating.

The plating solution for forming the plating layer B is a substitution plating solution. The plating solution contains a water-soluble metal salt (a salt of a third metal). The third metal has an ionization tendency capable of substitution with a first metal or a second metal. In other words, the third metal has lower ionization tendency than that of the first metal or the second metal.

Plating solution (a substitution plating solution) for forming the plating layer B is not particularly limited, as long as the solution does not locally corrode the object to be plated and does not form an oxidation layer on the surface of the object to be plated at the time of formation of the plating layer B on the plating layer A.

A water-soluble metal salt (a salt of a third metal) contained in a plating solution for forming a plating layer B is not particularly limited.

When the third metal is palladium, examples of the salt of a third metal are palladium chloride, dichlorotetraamine palladium salt and dinitrotetraamine palladium salt.

Concentration of a water-soluble metal salt (a salt of a third metal) in a plating solution for forming a plating layer B is not particularly limited. The concentration is preferably 5 ppm or more, more preferably 10 ppm or more, and particularly preferably 20 ppm or more. Besides, the concentration is preferably 5000 ppm or less, more preferably 2000 ppm or less, and particularly preferably 1000 ppm or less.

When the concentration is more than or equal to the above lower limit, formation rate of the plating layer B becomes sufficiently large. Further, when the concentration is equal to or lower than the above upper limit, it is advantageous in terms of cost.

PH of the plating solution for forming a plating layer B is preferably 2.5 or more, more preferably 3 or more, and particularly preferably 4 or more. Besides, the pH is preferably 9.5 or less, more preferably 9 or less, and particularly preferably 8 or less.

When the pH is within the above range, local corrosion of the object to be plated and formation of an oxidation layer on the surface of the plating body are unlikely to occur, thus it is easy to keep a plating stack at high quality.

Film thickness of a plating layer B is not particularly limited. The film thickness is preferably 0.0003 μm or more, more preferably 0.0005 μm or more, and particularly preferably 0.001 μm or more. Besides, the film thickness is preferably 0.05 μm or less, more preferably 0.04 μm or less, and particularly preferably 0.02 μm or less.

When the film thickness is more than or equal to the above lower limit, the next step, that is, formation of a plating layer C tends to proceed stably. Further, when the film thickness is equal to or lower than the above upper limit, it is advantageous in terms of cost.

Temperature of a plating solution at the time of forming a plating layer B is preferably 10° C. or higher, more preferably 15° C. or higher, and particularly preferably 20° C. or higher. Besides, the temperature is preferably 100° C. or lower, more preferably 95° C. or lower, and particularly preferably 90° C. or lower.

Further, time for forming the plating layer B (plating time) is preferably 0.5 minutes or more, more preferably 1 minute or more, and particularly preferably 2 minutes or more. Besides, the plating time is preferably 30 minutes or less, more preferably 20 minutes or less, and particularly preferably 10 minutes or less.

When the temperature and the plating time are within the above range, the film thickness tends to be within the above range.

<Plating Layer C>

A plating layer C is a plating layer to be deposited on a plating layer B. The plating layer C is mainly composed of a second metal, the third metal, or a fourth metal.

However, gold and/or nickel are excluded from the main component of the plating layer C.

The plating layer C is a reduction plating layer formed by a redox reaction between a reducing agent and a metal ion (an ion of the second metal, the third metal, or the fourth metal) contained in a reduction plating solution.

Metal of the main component of the plating layer C (the second metal, the third metal, or the fourth metal) is not particularly limited as long as it can be deposited from the reduction plating solution and can be stably present in an aqueous solution. Metal of the main component of the plating layer C can be selected according to the purpose of formation of a plating stack.

For example, palladium and so on may be used as the main component of the plating layer C in case the purpose is to prevent thermal diffusion of a first metals to the surface of the film.

A plating solution for forming plating layer C (a reduction plating solution) contains a water-soluble metal salt (a salt of a second metal, a third metal or a fourth metal) and a reducing agent.

Examples of the reducing agent are hypophosphorous acid and its salts, formic acid and its salts, and hydrazine. One type of the reducing agents may be used alone, or two or more type thereof may be used.

As the water-soluble metal salt contained in the plating solution for forming the plating layer C, the salts of the second metal and the salts of the third metal described above can be exemplified.

Concentration of a water-soluble metal salt in a plating solution for forming a plating layer C is not particularly limited. The concentration is preferably 5 ppm or more, more preferably 10 ppm or more, and particularly preferably 20 ppm or more. Besides, the concentration is preferably 5000 ppm or less, more preferably 2000 ppm or less, and particularly preferably 1000 ppm or less.

When the concentration is more than or equal to the above lower limit, formation rate of the plating layer C becomes sufficiently large. Further, when the concentration is equal to or lower than the above upper limit, it is advantageous in terms of cost.

PH of the plating solution for forming a plating layer C is preferably 2.5 or more, more preferably 3 or more, and particularly preferably 4 or more. Besides, the pH is preferably 9.5 or less, more preferably 9 or less, and particularly preferably 8 or less.

When the pH is within the above range, precipitation of the metal salt and deposition of the metal in the plating tank due to an abnormal reaction in the plating solution are less likely to occur.

The plating layer C is a layer formed for the purpose of preventing thermal diffusion to the surface of the film, and so on. Therefore, the film thickness of plating layer C is thicker than those of the plating layer A and the plating layer B. The plating layer C is formed by reduction plating, which is capable of forming a thick film.

In concrete terms, film thickness of a plating layer C is not particularly limited. The film thickness is preferably 0.01 μm or more, more preferably 0.02 μm or more, and particularly preferably 0.03 μm or more. Besides, the film thickness is preferably 3 μm or less, more preferably 2 μm or less, and particularly preferably 1 μm or less.

When the film thickness is more than or equal to the above lower limit, performance of the film can be sufficiently exerted. Further, when the film thickness is equal to or lower than the above upper limit, it is advantageous in terms of cost.

Temperature of a plating solution at the time of forming a plating layer C is preferably 10° C. or higher, more preferably 15° C. or higher, and particularly preferably 20° C. or higher. Besides, the temperature is preferably 100° C. or lower, more preferably 95° C. or lower, and particularly preferably 90° C. or lower.

Further, time for forming the plating layer C (plating time) is preferably 0.5 minutes or more, more preferably 1 minute or more, and particularly preferably 2 minutes or more.

Besides, the plating time is preferably 240 minutes or less, more preferably 120 minutes or less, and particularly preferably 60 minutes or less.

When the temperature and the plating time are within the above range, the film thickness tends to be within the above range.

Metal of the main component of the plating layer C can be the third metal. In this case, the main component of plating layer B and the plating layer C are identical.

For example, metal of the main component of the plating layer B and the plating layer C both can be palladium. That is, a palladium plating layer can be two layers, a substitution palladium plating layer and a reduction palladium plating layer.

By configuring like this, skipping of reduction plating is less likely to occur. Therefore, a relatively thick palladium layer can be stably formed.

<Plating Layer D>

In the present invention, after the plating layer C is deposited, a plating layer D mainly composed of a metal which differs from that of the plating layer C may be deposited on the plating layer C. FIG. 2 shows the structure of the plating stack produced by in that way.

A plating layer D is a plating layer to be deposited on a plating layer C. The main component metal of the plating layer D differs from that of the plating layer C.

The metal that constitutes the plating layer D may be an elemental metal, and may be an alloy.

Metal of the main component of the plating layer D is not particularly limited as long as it can be deposited from the plating solution and can be stably present in an aqueous solution. Metal of the main component of the plating layer D can be selected according to the purpose of formation of a plating stack.

For example, gold and so on may be used as the main component of the plating layer D in case the purpose is to prevent oxidation of the surface of the film.

The plating solution for forming the plating layer D may be a substitution plating solution or reduction plating solution.

A plating solution for forming the plating layer D contains a water-soluble metal salt. The water-soluble metal salt is not particularly limited.

For example, when the main component of the plating layer D is gold, examples of the water-soluble metal salt are gold cyanide salt, gold chloride salt, gold sulfite salt and gold thiosulfate salt.

Concentration of a water-soluble metal salt in a plating solution for forming a plating layer D is not particularly limited. The concentration is preferably 5 ppm or more, more preferably 10 ppm or more, and particularly preferably 20 ppm or more. Besides, the concentration is preferably 5000 ppm or less, more preferably 2000 ppm or less, and particularly preferably 1000 ppm or less.

When the concentration is more than or equal to the above lower limit, formation rate of the plating layer D becomes sufficiently large. Further, when the concentration is equal to or lower than the above upper limit, it is advantageous in terms of cost.

PH of the plating solution for forming a plating layer D is preferably 2.5 or more, more preferably 3 or more, and particularly preferably 4 or more. Besides, the pH is preferably 9.5 or less, more preferably 9 or less, and particularly preferably 8 or less.

When the pH is within the above range, precipitation of the metal salt and deposition of the metal in the plating tank due to an abnormal reaction in the plating solution are less likely to occur.

Film thickness of a plating layer D is not particularly limited. The film thickness is preferably 0.01 μm or more, more preferably 0.02 μm or more, and particularly preferably 0.03 μm or more. Besides, the film thickness is preferably 1 μm or less, more preferably 0.7 μm or less, and particularly preferably 0.5 μm or less.

When the film thickness is more than or equal to the above lower limit, performance of the film can be sufficiently exerted. Further, when the film thickness is equal to or lower than the above upper limit, it is advantageous in terms of cost.

Temperature of a plating solution at the time of forming a plating layer D is preferably 10° C. or higher, more preferably 15° C. or higher, and particularly preferably 20° C. or higher. Besides, the temperature is preferably 100° C. or lower, more preferably 95° C. or lower, and particularly preferably 90° C. or lower.

Further, time for forming the plating layer D (plating time) is preferably 0.5 minutes or more, more preferably 1 minute or more, and particularly preferably 2 minutes or more. Besides, the plating time is preferably 240 minutes or less, more preferably 120 minutes or less, and particularly preferably 60 minutes or less.

When the temperature and the plating time are within the above range, the film thickness tends to be within the above range.

A plating stack produced by the method of the present invention can maintain a high bond strength upon soldering on it and can be produced stably. Although above operation and principle are not clear, but are deduced as follows. However, the present invention is not limited to the scope of the following operation and principle.

As in Patent Document 1, when a layer of palladium or its alloys, etc. is added directly to an object to be plated, local corrosion of the object to be plated and formation of an oxidized layer on the surface of the object to be plated occur. In contrast, after forming a plating layer A on the surface of an object to be plated, by forming palladium or its alloys, etc. as a plating layer B, the plating layer A becomes a protective layer of the object to be plated, then the plating layer B can be formed while preventing local corrosion of the object to be plated and formation of an oxidized layer on the surface of the object to be plated.

Besides, on the surface of the plating layer B, reduction reaction is more likely to proceed than on the surface of the plating layer A, therefore the plating layer C can be stably formed by reduction plating after forming the plating layer B.

Therefore, in the present invention, plating films having performance required can be stably produced while preventing local corrosion of the object to be plated and formation of an oxidized layer on the surface of the object to be plated, and films produced by the present invention maintain high solder bonding strength.

EXAMPLES

Hereinafter, the present invention will be explained more specifically by showing Examples and Comparative Examples; but the present invention is not limited to them unless beyond its scope.

Example 1

[Production of a Plating Stack]

A glass cloth epoxy material (FR-4) was bonded with copper foil. An opening system of φ0.5 mm diameter was arranged on the glass cloth epoxy material to produce a substrate (40 mm×40 mm×1 mmt). The substrate was adopted as an object to be plated. In the following manner, a plating stack which is stacked in the order of the object to be plated, a plating layer A, a plating layer B and a plating layer C was produced.

Degreasing, soft etching and acid cleaning were performed on the object to be plated. Degreasing was carried out using a commercially available cleaning solution (PAC-200, manufactured by Murata Co., Ltd.) for 10 minutes at 50° C. Soft etching was carried out using a commercially available soft etching agent (MEOX, manufactured by Murata Co., Ltd.) for 5 minutes at 30° C. Acid cleaning was carried out using 10 v/v % sulfuric acid for 1 minute at room temperature.

A plating layer A was formed using a substitution gold plating solution (IM-GOLD PC, manufactured by Japan Pure Chemical Co., Ltd.). Temperature of the plating solution for forming the plating layer A was 80° C., and plating time was 5 minutes.

Next, a plating layer B was formed using a substitution palladium plating solution (IM-Pd NCA, manufactured by Japan Pure Chemical Co., Ltd.). Temperature of the plating solution for forming the plating layer B was 55° C., and plating time was 5 minutes.

Next, a plating layer C was formed using a reduction palladium plating solution (Neo Pallabright DP, manufactured by Japan Pure Chemical Co., Ltd.). As a contaminant assumed in practical use, 0.1 g/L of copper sulfate pentahydrate (Wako Pure Chemical Industries, Co., Ltd.) was added in the reduction palladium plating solution. Temperature of the plating solution for forming the plating layer C was 50° C., and plating time was 5 minutes.

[Measurement of Film Thickness of a Plating Layer]

Thickness of each plating layer formed was measured by a fluorescent X-ray spectroscopy analyzer (FT-150, Hitachi High-Tech Science, Co., Inc.).

The film thickness of the plating layer A obtained in Example 1 was 0.005 μm, the thickness of the plating layer B was 0.005 μm, and the thickness of the plating layer C was 0.05 μm.

Evaluation of Skipping of the Plating Layer C

Vicinity of the opening was observed by an optical microscope at a magnification of 10 times. If the vicinity of the opening was-silver white, skipping of the plating layer C was determine to be "No". If the vicinity of the opening was orange or brown, skipping of the plating layer C was determined to be "Yes".

Skipping of the plating layer C was not seen in the plating stack obtained in Example 1.

[Evaluation of Solder Bondability]

The plating stack produced by stacking plating layers on the object to be plated was preheated. Then, solder balls (Senju Metal Industry Co., Ltd., SAC405, φ0.6 mm) were implemented on the SR opening using a reflow device (Japan Pulse Technology Laboratory Co., Ltd., RF-430-M2). Ball-pull test was performed using a bond tester (Dage Co., Ltd., bond tester SERIES4000 OPTIMA), and the rupture mode was evaluated.

The ball-pull test was performed at 20 points for each plating stack. The rupture inside the solder was evaluated as "good". The rupture at the interface of solder and ground was evaluated as "bad". Then the percentage of "good" was calculated as good product rate of solder bondability (%).

Conditions such as implementation of solder are as follows.

Reflow environment: Under nitrogen atmosphere
Heating before reflow: 175° C. for 4 hours
Number of reflow before implementation: 3 times
Flux: KESTER Co., Ltd.; TSF6502
Test speed: 5000 μm/sec
Aging after solder mounting: 1 hour Solder bondability of the plating stack obtained in Example 1 was good.

Example 2

A plating stack was produced and evaluated as in Example 1, except that the plating time for forming the plating layer A was set to 10 minutes.

The film thickness of the plating layer A obtained was 0.01 μm, the film thickness of the plating layer B was 0.005 μm, and the film thickness of the plating layer C was 0.05 μm.

Skipping of the plating layer C was not seen, and solder bondability of the plating stack obtained was good.

Example 3

A plating stack was produced and evaluated as in Example 1, except that the plating time for forming the plating layer B was set to 10 minutes.

The film thickness of the plating layer A obtained was 0.005 μm, the film thickness of the plating layer B was 0.01 μm, and the film thickness of the plating layer C was 0.05 μm.

Skipping of the plating layer C was not seen, and solder bondability of the plating stack obtained was good.

Example 4

A plating stack was produced and evaluated as in Example 1, except that the plating time for forming the plating layer C was set to 10 minutes.

The film thickness of the plating layer A obtained was 0.005 μm, the film thickness of the plating layer B was 0.005 μm, and the film thickness of the plating layer C was 0.1 μm.

Skipping of the plating layer C was not seen, and solder bondability of the plating stack obtained was good.

Example 5

A plating stack was produced and evaluated as in Example 1, except that a plating layer A was formed using a substitution silver plating solution (IM-SILVER, manufactured by Japan Pure Chemical Co., Ltd.), that the temperature of the plating solution was set to 45° C. and that the plating time was set to 1 minute.

The film thickness of the plating layer A obtained was 0.005 μm, the film thickness of the plating layer B was 0.005 μm, and the film thickness of the plating layer C was 0.05 μm.

Skipping of the plating layer C was not seen, and solder bondability of the plating stack obtained was good.

Example 6

A plating stack was produced and evaluated as in Example 1, except that a plating layer A was formed using a commercially available substitution platinum plating solution (weakly acidic chloroplatinic acid type plating solution) and that the temperature of the plating solution was set to 45° C.

The film thickness of the plating layer A obtained was 0.005 μm, the film thickness of the plating layer B was 0.005 μm, and the film thickness of the plating layer C was 0.05 μm.

Skipping of the plating layer C was not seen, and solder bondability of the plating stack obtained was good.

Example 7

A plating stack was produced and evaluated as in Example 1, except that a plating layer A was formed using a reduction gold plating solution (HY-GOLD CN, manufactured by Japan Pure Chemical Co., Ltd.) and that the plating time was set to 1 minute.

The film thickness of the plating layer A obtained was 0.005 μm, the film thickness of the plating layer B was 0.005 μm, and the film thickness of the plating layer C was 0.05 μm.

Skipping of the plating layer C was not seen, and solder bondability of the plating stack obtained was good.

Example 8

A plating stack was produced and evaluated as in Example 1, except that a plating layer A was formed using a commercially available reduction silver plating solution (weakly alkaline silver nitrate type plating solution), that the temperature of the plating solution was set to 50° C. and that the plating time was set to 1 minute.

The film thickness of the plating layer A obtained was 0.005 μm, the film thickness of the plating layer B was 0.005 μmm, and the film thickness of the plating layer C was 0.05 μm.

Skipping of the plating layer C was not seen, and solder bondability of the plating stack obtained was good.

Example 9

A plating stack was produced and evaluated as in Example 1, except that a plating layer A was formed using a reduction platinum plating solution (OT-1, manufactured by Japan Pure Chemical Co., Ltd.), that the temperature of the plating solution was set to 30° C. and that the plating time was set to 1 minute.

The film thickness of the plating layer A obtained was 0.005 μm, the film thickness of the plating layer B was 0.005 μm, and the film thickness of the plating layer C was 0.05 μm.

Skipping of the plating layer C was not seen, and solder bondability of the plating stack obtained was good.

Example 10

After forming of the plating layer C in Example 1, a plating layer D was formed using a reduction gold plating solution (HY-GOLD CN, manufactured by Japan Pure Chemical Co., Ltd.). Temperature of the plating solution for forming the plating layer D was 80° C., and plating time was 10 minutes. The produced plating stack was evaluated as in Example 1.

The film thickness of the plating layer A obtained was 0.005 μm, the film thickness of the plating layer B was 0.005 μm, the film thickness of the plating layer C was 0.05 μm and the film thickness of the plating layer D was 0.05 μm.

Skipping of the plating layer C was not seen, and solder bondability of the plating stack obtained was good.

Comparative Example 1

A plating stack was produced and evaluated as in Example 1, except that a plating layer A was not formed but a plating layer B was directly formed on an object to be plated.

The film thickness of the plating layer B obtained was 0.005 μm, and the film thickness of the plating layer C was 0.05 μm.

Skipping of the plating layer C was not seen, but solder bondability of the plating stack obtained was bad.

Comparative Example 2

A plating stack was produced and evaluated as in Example 1, except that a plating layer B was not formed but a plating layer C was formed after forming a plating layer A.

The film thickness of the plating layer A obtained was 0.005 μm, and the film thickness of the plating layer C was 0.05 μm.

Skipping of the plating layer C was seen. Solder bondability of area where the skipping did not occur was good.

Comparative Example 3

A plating stack was produced and evaluated as in Example 5, except that a plating layer B was not formed but a plating layer C was tried to form after forming a plating layer A.

The film thickness of the plating layer A obtained was 0.005 μm, but formation of the plating layer C did not proceed.

Comparative Example 4

A plating stack was produced and evaluated as in Example 6, except that a plating layer B was not formed but a plating layer C was formed after forming a plating layer A.

The film thickness of the plating layer A obtained was 0.005 μm, and the film thickness of the plating layer C was 0.05 μm.

Skipping of the plating layer C was seen. Solder bondability of the place where the skipping did not occur was good.

The results of each of the examples and comparative examples are shown in Table 1.

TABLE 1

| | Plating layer A | | | | | Plating layer B | | | | |
|---|---|---|---|---|---|---|---|---|---|---|
| | Component metal | Method of plating | Temperature (° C.) | Time (minutes) | Film thickness (μm) | Component metal | Method of plating | Temperature (° C.) | Time (minutes) | Film thickness (μm) |
| Example 1 | Gold | Substitution | 80 | 5 | 0.005 | Palladium | Substitution | 55 | 5 | 0.005 |
| Example 2 | Gold | Substitution | 80 | 10 | 0.01 | Palladium | Substitution | 55 | 5 | 0.005 |
| Example 3 | Gold | Substitution | 80 | 5 | 0.005 | Palladium | Substitution | 55 | 10 | 0.01 |
| Example 4 | Gold | Substitution | 80 | 5 | 0.005 | Palladium | Substitution | 55 | 5 | 0.005 |
| Example 5 | Silver | Substitution | 45 | 1 | 0.005 | Palladium | Substitution | 55 | 5 | 0.005 |
| Example 6 | Platinum | Substitution | 45 | 5 | 0.005 | Palladium | Substitution | 55 | 5 | 0.005 |
| Example 7 | Gold | Reduction | 80 | 1 | 0.005 | Palladium | Substitution | 55 | 5 | 0.005 |
| Example 8 | Silver | Reduction | 50 | 1 | 0.005 | Palladium | Substitution | 55 | 5 | 0.005 |
| Example 9 | Platinum | Reduction | 30 | 1 | 0.005 | Palladium | Substitution | 55 | 5 | 0.005 |
| Example 10 | Gold | Substitution | 80 | 5 | 0.005 | Palladium | Substitution | 55 | 5 | 0.005 |
| Comparative example 1 | — | — | — | — | — | Palladium | Substitution | 55 | 5 | 0.005 |
| Comparative example 2 | Gold | Substitution | 80 | 5 | 0.005 | — | — | — | — | — |
| Comparative example 3 | Silver | Substitution | 45 | 1 | 0.005 | — | — | — | — | — |
| Comparative example 4 | Platinum | Substitution | 45 | 5 | 0.005 | — | — | — | — | — |

| | Plating layer C | | | | | Plating layer D |
|---|---|---|---|---|---|---|
| | Component metal | Method of plating | Temperature (° C.) | Time (minutes) | Film thickness (μm) | Component metal |
| Example 1 | Palladium | Reduction | 50 | 5 | 0.05 | — |
| Example 2 | Palladium | Reduction | 50 | 5 | 0.1 | — |
| Example 3 | Palladium | Reduction | 50 | 5 | 0.05 | — |
| Example 4 | Palladium | Reduction | 50 | 10 | 0.05 | — |
| Example 5 | Palladium | Reduction | 50 | 5 | 0.05 | — |
| Example 6 | Palladium | Reduction | 50 | 5 | 0.05 | — |
| Example 7 | Palladium | Reduction | 50 | 5 | 0.05 | — |
| Example 8 | Palladium | Reduction | 50 | 5 | 0.05 | — |
| Example 9 | Palladium | Reduction | 50 | 5 | 0.05 | — |
| Example 10 | Palladium | Reduction | 50 | 5 | 0.05 | Gold |
| Comparative example 1 | Palladium | Reduction | 50 | 5 | 0.05 | — |
| Comparative example 2 | Palladium | Reduction | 50 | 5 | (0.05)[a] | — |
| Comparative example 3 | Palladium | Reduction | 50 | 5 | (0)[b] | — |
| Comparative example 4 | Palladium | Reduction | 50 | 5 | (0.05)[a] | — |

| | Plating layer D | | | | | Good product |
|---|---|---|---|---|---|---|
| | Method of plating | Temperature (° C.) | Time (minutes) | Film thickness (μm) | Skipping of plating layer C | rate of solder bendability (%) |
| Example 1 | — | — | — | — | No | 100 |
| Example 2 | — | — | — | — | No | 100 |
| Example 3 | — | — | — | — | No | 100 |
| Example 4 | — | — | — | — | No | 100 |
| Example 5 | — | — | — | — | No | 100 |
| Example 6 | — | — | — | — | No | 100 |
| Example 7 | — | — | — | — | No | 100 |
| Example 8 | — | — | — | — | No | 100 |
| Example 9 | — | — | — | — | No | 100 |
| Example 10 | Reduction | 80 | 10 | 0.05 | No | 100 |
| Comparative example 1 | — | — | — | — | No | 20 |
| Comparative example 2 | — | — | — | — | Yes | (100)[c] |
| Comparative example 3 | — | — | — | — | Yes | Unmeasurable |
| Comparative example 4 | — | — | — | — | Yes | (100)[c] |

In Table 1, bracketed items denote the following:

a: Film thickness measured only at area where skipping of the plating layer C did not occur.

b: Skipping occurred at all measurement points.

c: Good product rate measured only at area where skipping of the plating layer C did not occur.

INDUSTRIAL APPLICABILITY

A method for producing a plating stack of the present invention can stably produce a plating stack having performance required for surface of conductor circuits or the like while maintaining high solder bonding strength. The present invention can be widely used in the field such as manufacturing of electrical and electronic component and so on.

REFERENCE SIGNS LIST

S: object to be plated

A: plating layer A

B: plating layer B

C: plating layer C

D: plating layer D

The invention claimed is:

1. A method for producing a plating stack in which a plating layer A mainly composed of gold, platinum or silver is deposited on an object to be plated mainly composed of copper, then a plating layer B mainly composed of palladium is deposited on the plating layer A, and then a plating layer C mainly composed of palladium is deposited on the plating layer B, wherein the plating layer B is a substitution plating layer formed by a substitution reaction between a palladium ion contained in a substitution plating solution, and copper contained in the object to be plated or gold, platinum or silver contained in the plating layer A, wherein the plating layer C is a reduction plating layer, formed by a redox reaction between a reducing agent and a palladium ion contained in a reduction plating solution.

2. The method for producing a plating stack according to claim 1, wherein the plating layer A is a substitution plating layer formed by a substitution reaction between an ion of gold, platinum or silver contained in a substitution plating solution and copper contained in the object to be plated.

3. The method for producing a plating stack according to claim 1, wherein after the plating layer C is deposited, a plating layer D mainly composed of a metal which differs from palladium is deposited on the plating layer C.

4. The method for producing a plating stack according to claim 3, wherein a metal which is a main component of the plating layer D is gold.

* * * * *